US006540625B2

(12) United States Patent
Sajima

(10) Patent No.: US 6,540,625 B2
(45) Date of Patent: Apr. 1, 2003

(54) GOLF BALL

(75) Inventor: Takahiro Sajima, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/873,239

(22) Filed: Jun. 5, 2001

(65) Prior Publication Data

US 2002/0019274 A1 Feb. 14, 2002

(30) Foreign Application Priority Data

Jun. 23, 2000 (JP) ..... 2000-189178

(51) Int. Cl.[7] ..... A63B 37/14
(52) U.S. Cl. ..... 473/383; 473/382
(58) Field of Search ..... 473/378, 382, 473/383, 384

(56) References Cited

U.S. PATENT DOCUMENTS 4,720,111 A 1/1988 Yamada
4,915,389 A * 4/1990 Ihara ..... 473/383
5,145,180 A 9/1992 Oka
5,149,100 A * 9/1992 Melvin et al. ..... 473/383
5,201,523 A * 4/1993 Miller ..... 473/383
5,253,872 A * 10/1993 Lemons ..... 473/378
5,415,410 A * 5/1995 Aoyama ..... 473/383

FOREIGN PATENT DOCUMENTS

JP 11-70186 3/1999

* cited by examiner

*Primary Examiner*—Mark S. Graham
*Assistant Examiner*—Raeann Gorden
(74) *Attorney, Agent, or Firm*—Birch, Stewart, Kolasch & Birch, LLP

(57) ABSTRACT

A surface is comparted into eight spherical regular triangles (T1 to T8) through twelve comparting lines formed by projecting twelve sides of a regular octahedron inscribed on the surface onto the surface. A dimple is arranged for each spherical regular triangle. In each of six apexes (P1 to P6), dimple patterns of four spherical regular triangles sharing the apexes are not identical to each other. Moreover, the dimple patterns of the two spherical regular triangles sharing each of the apexes and opposed to each other are neither line symmetrical nor point symmetrical with each other. In each of the twelve comparting lines, furthermore, the dimple patterns of two spherical regular triangles sharing the comparting line are neither line symmetrical nor point symmetrical. In such a golf ball, it is possible to prevent dimple effects from being reduced when one of comparting great circles (L1, L2 and L3) is coincident with the highest speed portion.

7 Claims, 8 Drawing Sheets

T2

GOLF BALL

BACKGROUND OF THE INVENTION

1. Field of the Invention

The present invention relates to a golf ball and more particularly to a dimple pattern of the golf ball.

2. Description of the Related Art

A golf ball has approximately 300 to 550 dimples on a surface thereof. The role of the dimples resides in one aspect that such dimples disturb an air stream around the golf ball during the flight of the golf ball to accelerate transition of a turbulent flow at a boundary layer, thereby causing a turbulent flow separation (which will be hereinafter referred to as a "dimple effect"). The acceleration of the transition of the turbulent flow causes a separating point of air from the golf ball to be shifted backwards so that a pressure resistance is reduced, resulting in an increase in a flight distance of the golf ball. Moreover, the acceleration of the transition of the turbulent flow increases a distance between upper and lower separating points of the golf ball which is caused by backspin. Consequently, lift acting on the golf ball is increased. Accordingly, a dimple pattern capable of easily accelerating the transition of the turbulent flow, that is, a dimple pattern capable of better disturbing an air stream is more excellent aerodynamically.

A regular polyhedron or a quasi-regular polyhedron (which will be hereinafter referred to as a "polyhedron) is often used for the dimple pattern. More specifically, a polyhedron inscribed on a sphere is supposed, and sides of the polyhedron are projected on a spherical surface by rays irradiated from the center of the sphere onto the spherical surface, thereby forming a comparting line. The spherical surface is comparted by the comparting line. Thus, the dimples are arranged. Examples of the polyhedron to be used include a regular hexahedron, a regular octahedron, a regular dodecahedron, a regular icosahedron, a cube-octahedron, an icosa-dodecahedron and the like.

The regular octahedron has been used for a general golf ball for a long time because dimples are systematically aligned finely. Twelve comparting lines obtained by projecting twelve sides of the regular octahedron form three great circles (which will be hereinafter referred to as a "comparting great circle"). These comparting great circles are orthogonal to each other. The spherical surface is comparted into eight spherical regular triangles through the twelve comparting lines (that is, three comparting great circles). Dimples are arranged for each spherical regular triangle. Such a dimple pattern is referred to as a regular octahedron pattern. Usually, the dimple is provided on the inside of the spherical regular triangle and does not intersect the twelve comparting lines. Accordingly, the three comparting great circles do not intersect the dimple. Portions corresponding to the comparting great circles act as great circle paths where the dimple is not present. By the existence of the great circle path, there is an advantage that a directional alignment can easily be carried out before patting.

The golf ball is formed by upper and lower molds comprising semispherical cavities. A spew is generated in a portion (a so-called seam) corresponding to the parting lines of the upper and lower molds on the surface of the formed golf ball. The spew is ground and removed through a grindstone or the like. In an ordinary regular octahedron pattern, one of the three great circle paths is coincident with the seam. Consequently, the dimple is not present on the seam and the spew can easily be removed. Such a golf ball has been disclosed in Japanese Laid-Open Patent Publication No. Sho 60-11665 (1985/11665).

In the golf ball having the regular octahedron pattern, dimples are not present on the seam, so a dimple effect tends to be insufficient when the seam (to be the great circle path) is coincident with a portion in which a circumferential speed of backspin is the highest (which will be hereinafter referred to as the "highest speed portion"). As described above, the spew generated on the seam is removed by the grinding, so there is a possibility that the vicinity of the seam of the surface of the golf ball might be ground simultaneously during the removal and the dimples might be deformed, resulting in a reduction in the dimple effect. Furthermore, the dimple patterns on the right and left of the seam are identical or equivalent to each other and the identical or equivalent dimple patterns appear repetitively along the seam during the rotation of the golf ball. Therefore, the dimple effect tends to be insufficient when the seam is coincident with the highest speed portion. More specifically, in the golf ball having the regular octahedron pattern, the following three unfavorable conditions are satisfied on the seam:

(1) the seam is a great circle path having no dimple;

(2) dimples provided around the seam might be deformed by grinding; and (3) a dimple pattern appearing along the seam by rotation is monotonous.

Moreover, the drawbacks (1) and (3) described above are caused when two other great circle paths, as well as the seam, are coincident with the highest speed portion.

Japanese Laid-Open Patent Publication No. Hei 11-70186 (1999/70186) has disclosed a golf ball having a regular octahedron pattern in which a dimple is provided on a comparting great circle. In the golf ball, the great circle path is not formed. Therefore, the drawback (1) can be eliminated. However, the drawbacks (2) and (3) are still caused on the seam. For two comparting great circles other than the seam, the drawback (3) is caused.

SUMMARY OF THE INVENTION

In consideration of the above-mentioned problems, it is an object of the present invention to provide a golf ball comprising a dimple pattern to be a regular octahedron pattern and capable of preventing dimple effects from being reduced when a comparting great circle is coincident with the highest speed portion.

In order to achieve the above-mentioned object, the present invention provides a golf ball in which twelve sides of a regular octahedron inscribed on a surface of the golf ball are projected onto the surface so that the surface is comparted into eight spherical regular triangles through twelve comparting lines virtually formed and three great circles are formed, and a plurality of dimples are arranged on the spherical regular triangles and all the three great circles intersect the dimples, wherein dimple patterns of four spherical regular triangles sharing each of six apexes of the regular octahedron positioned on the surface are not identical to each other, dimple patterns of two spherical regular triangles sharing each of the six apexes of the regular octahedron positioned on the surface and opposed to each other are neither line symmetrical nor point symmetrical with each other, and dimple patterns of two spherical regular triangles sharing each of the twelve comparting lines are neither line symmetrical nor point symmetrical with each other.

In the golf ball, as described below in detail, when the comparting great circle is coincident with the highest speed portion, the dimple patterns of right and left spherical regular triangles of the comparting great circle are neither identical nor equivalent to each other. Moreover, when the golf ball rotates, the spherical regular triangles having dimple patterns which are neither identical nor equivalent sequentially appear along the comparting great circle. Accordingly, the dimple patterns appearing through the rotation are not monotonous so that dimple effects can be enhanced when the comparting great circle is coincident with the highest speed portion. Consequently, the flight distance of the golf ball can be increased, and furthermore, flight performance can be prevented from being varied depending on a position of the highest speed portion.

It is preferable that all the twelve comparting lines should intersect the dimples. Consequently, the dimple effects can be more enhanced when the comparting great circle is coincident with the highest speed portion.

It is preferable that each of the eight spherical regular triangles should have an internal dimple pattern which is neither rotation symmetrical nor line symmetrical. Consequently, the dimple pattern in each spherical regular triangle approximates a disorder so that the dimple effects can be enhanced.

It is preferable that the number of dimples arranged in each of the eight spherical regular triangles should be 40 to 55. Consequently, excellent dimple effects can be produced and the flight performance of the golf ball can be enhanced.

In the eight spherical regular triangles, a difference between the number of dimples in the spherical regular triangle having the greatest number of dimples arranged therein and the number of dimples in the spherical regular triangle having the smallest number of dimples arranged therein is preferably four or less. Consequently, the aerodynamic symmetry of the golf ball can be enhanced.

It is preferable that there should be no dimple having a center thereof positioned on the comparting line. Consequently, the dimple intersecting the comparting line is unevenly present on the spherical regular triangles on both sides of the comparting line. Consequently, the dimple effects can be more enhanced.

The present invention is also suitable for a golf ball in which one of three comparting great circles is almost coincident with a seam. The seam has such a drawback that surrounding dimples might be deformed by grinding. However, the dimple patterns appearing through the rotation are not monotonous, so it is possible to prevent the dimple effects from being reduced when the seam is coincident with the highest speed portion.

DESCRIPTION OF THE PREFERRED EMBODIMENTS

The present invention will be described below in detail based on a preferred embodiment with reference to the drawings.

Figure 1:
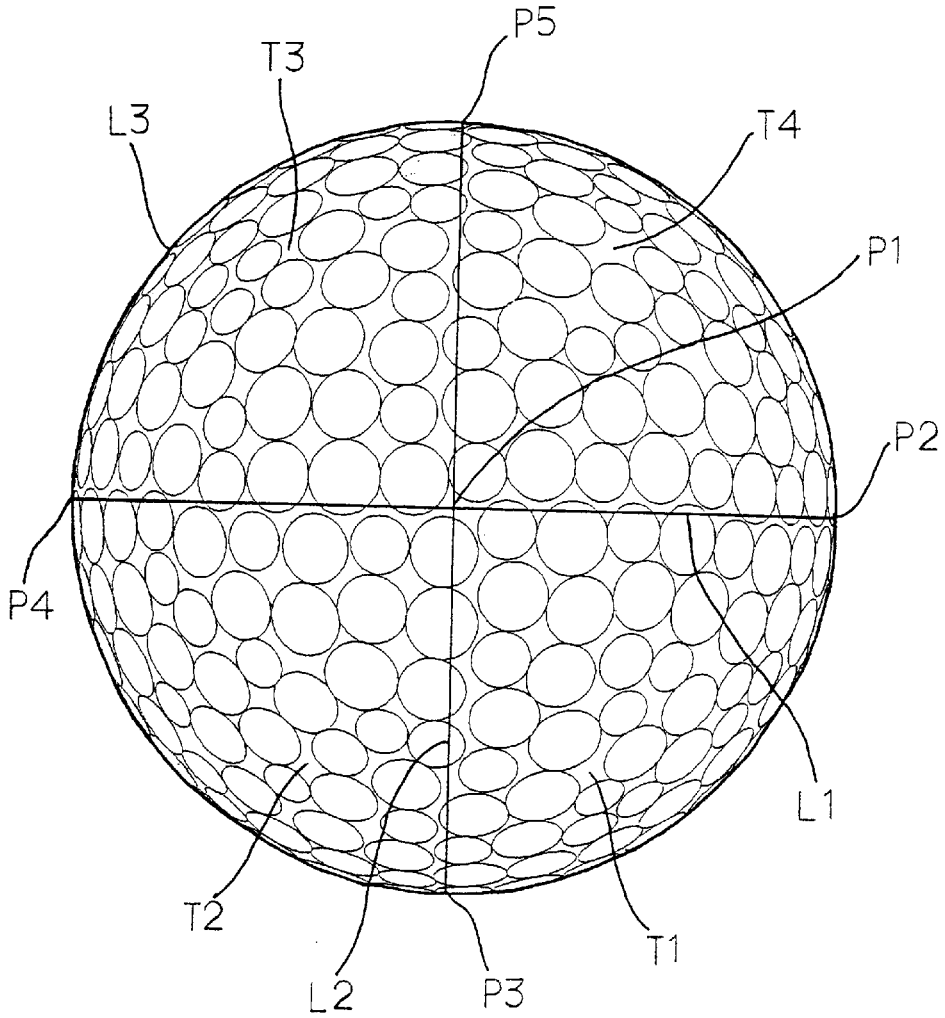
FIG. 1 is a front view showing a golf ball according to an embodiment of the present invention.
Figure 2:
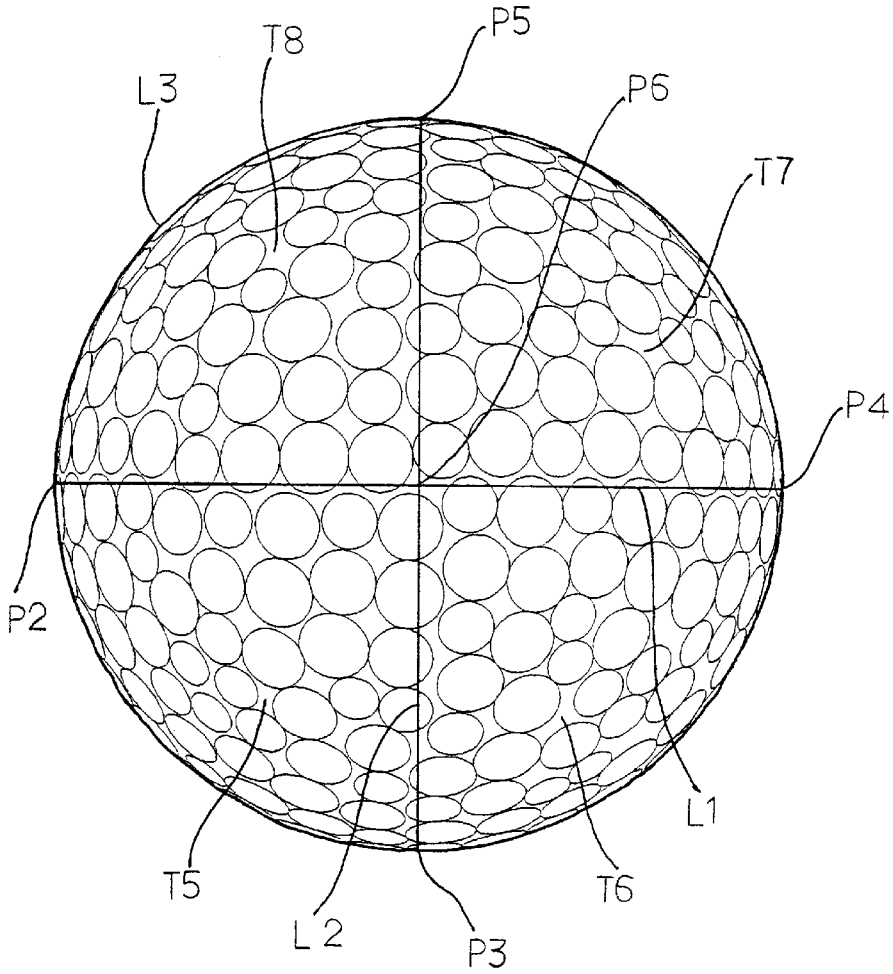
FIG. 2 is a rear view showing the golf ball of FIG. 1.

FIG. 1 is a front view showing a golf ball according to an embodiment of the present invention, and FIG. 2 is a rear view showing the golf ball of FIG. 1. The golf ball usually has a diameter of approximately 42.67 mm to 43.00 mm. The golf ball has 408 dimples on a surface thereof. The planar shape of the dimple is circular.

The dimple of the golf ball has a regular octahedron pattern. More specifically, a regular octahedron inscribed on a spherical surface is supposed, and the spherical surface is comparted into eight spherical regular triangles through twelve comparting lines obtained by projecting twelve sides of the regular octahedron. FIG. 1 shows four spherical regular triangles T1 to T4. Moreover, FIG. 2 shows four spherical regular triangles T5 to T8. The dimple is arranged for each of the spherical regular triangles (T1 to T8). Four comparting lines are continuous so that three comparting great circles L1 to L3 are formed. The comparting great circle L3 is coincident with the contour of the golf ball in FIGS. 1 and 2. The respective comparting great circles (L1 to L3) are orthogonal to other comparting great circles at apexes (P1 to P6) of the spherical regular triangles. The apexes (P1 to P6) correspond to apexes of the supposed regular octahedron. In an actual golf ball, the comparting line and the comparting great circles (L1 to L3) are not recognized as edges but are shown in a solid line of FIGS. 1 and 2 for convenience of description.

Figure 3:
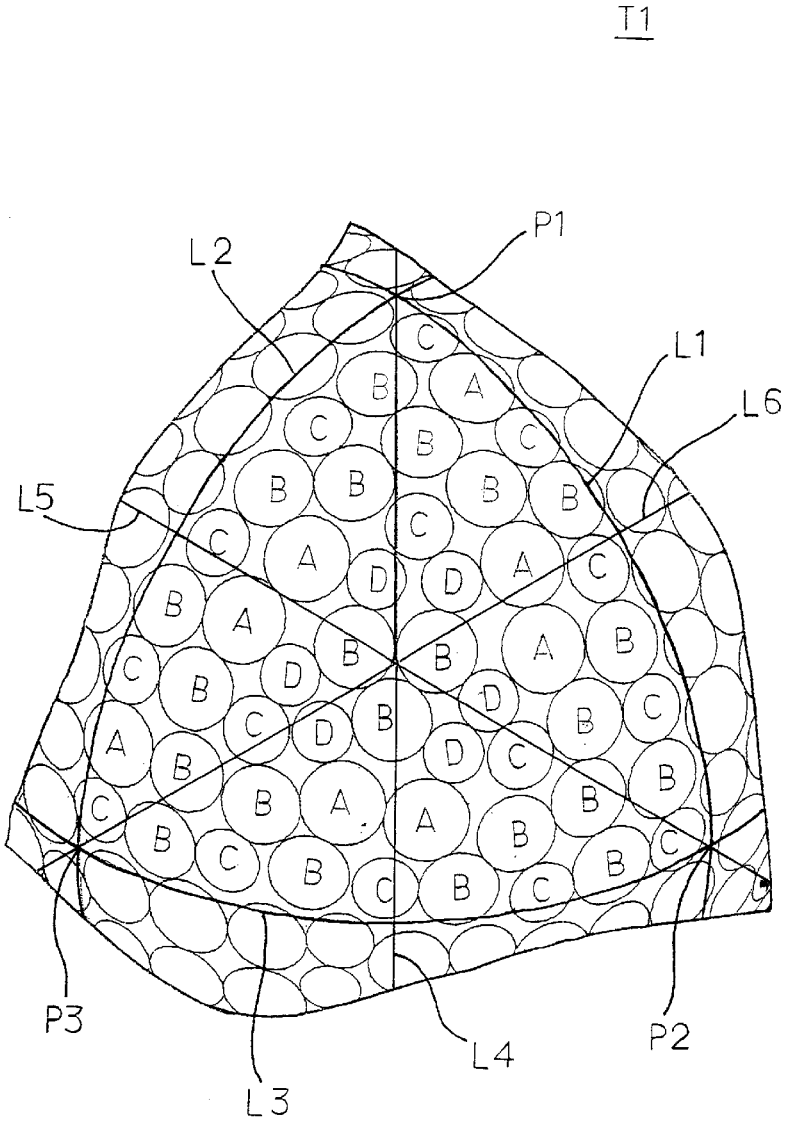
FIG. 3 is an enlarged view showing a spherical regular triangle T1 of the golf ball illustrated in FIG. 1.

FIG. 3 is an enlarged view showing the spherical regular triangle T1. The spherical regular triangle T1 includes nine Adimples having a diameter of 4.2 mm, twenty-one B dimples having a diameter of 3.95 mm, fifteen C dimples having a diameter of 3.3 mm and six D dimples having a diameter of 2.95 mm. The total number of dimples is 51.

In this specification, when the spherical regular triangle T1 is taken as an example, the dimple included in the spherical regular triangle T1 implies a dimple having a center thereof positioned in the spherical regular triangle T1. Accordingly, even if a dimple having a part thereof included in the spherical regular triangle T1 and a center included in another spherical regular triangle does not imply a dimple included in the spherical regular triangle T1. A dimple having a center positioned on any of the three comparting lines of the spherical regular triangle T1 implies a dimple included in the spherical regular triangle T1 and also in an adjacent spherical regular triangle. In the case in which the number of dimples included in the spherical regular triangle T1 is to be calculated, a dimple having a center positioned on any of the three comparting lines is counted as 0.5. Moreover, a dimple having a center thereof positioned on any of six apexes (P1 to P6) is set to be a dimple included in all of four spherical regular triangles sharing the apex and is counted as 0.25 when the number of dimples included in each spherical regular triangle is to be calculated.

As is apparent from FIG. 3, four of the 51 dimples included in the spherical regular triangle T1 intersect the comparting great circle L1. Moreover, four other dimples intersect the comparting great circle L2. Furthermore, four other dimples intersect the comparting great circle L3.

The dimple pattern of the spherical regular triangle T1 is not line symmetrical with respect to the great circle L4 connecting the apex P1 to a center of gravity of the spherical regular triangle T1. Moreover, the same dimple pattern is not line symmetrical with respect to the great circle L5 connecting the apex P2 to a center of gravity of the spherical regular triangle T1. Furthermore, the same dimple pattern is not line symmetrical with respect to the great circle L6 connecting the apex P3 to a center of gravity of the spherical regular triangle T1. As is apparent from the foregoing, there is no line dividing the dimple pattern symmetrically in a transverse direction. In other words, the dimple patterns in the spherical regular triangle T1 are not line symmetrical.

Even if the dimple pattern of the spherical regular triangle T1 is rotated around a center of gravity (an intersecting point of the great circles L4, L5 and L6), all the dimples do not completely overlap with the dimples which have not been rotated before a rotating angle reaches 360 degrees. In other words, the dimple patterns in the spherical regular triangle T1 are not rotation symmetrical.

The dimple pattern of the spherical regular triangle T7 is also equivalent to that of the spherical regular triangle T1 shown in FIG. 3. The dimple pattern will be hereinafter indicated as (I).

Figure 4:
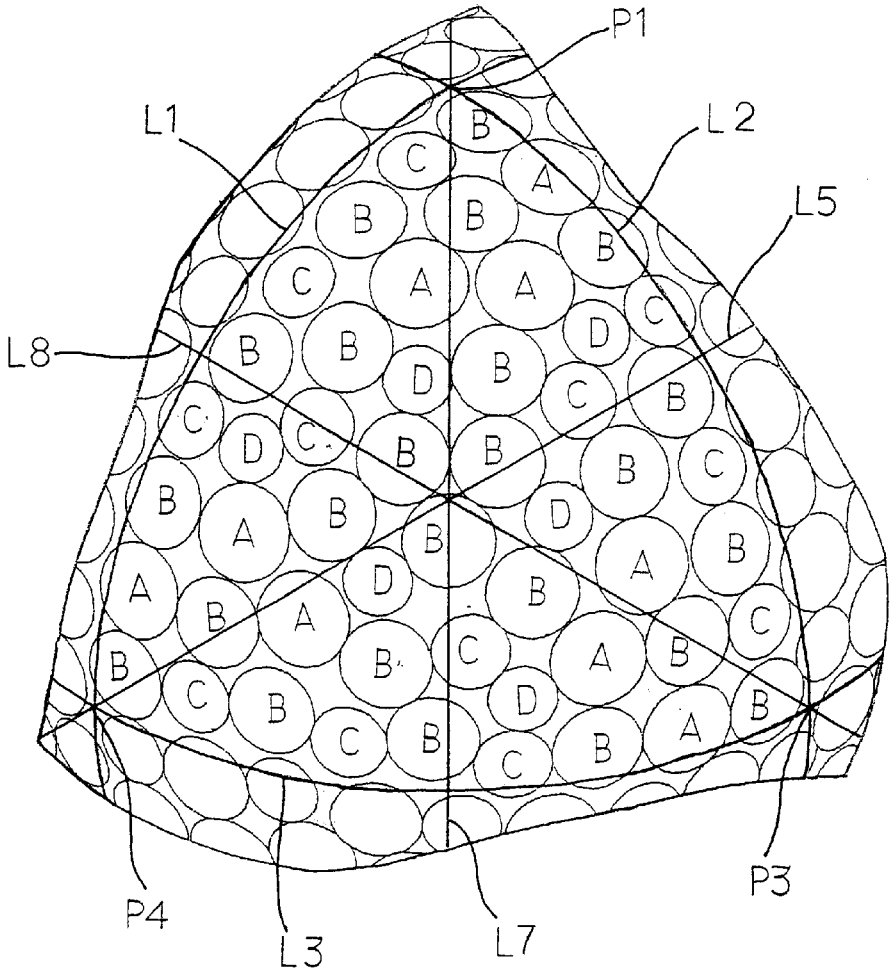
FIG. 4 is an enlarged view showing a spherical regular triangle T2 of the golf ball illustrated in FIG. 1.

FIG. 4 is an enlarged view showing the spherical regular triangle T2. The spherical regular triangle T2 includes nine A dimples having a diameter of 4.2 mm, twenty-four B dimples having a diameter of 3.95 mm, twelve C dimples having a diameter of 3.3 mm and six D dimples having a diameter of 2.95 mm. The total number of dimples is 51.

As is apparent from FIG. 4, four of the 51 dimples included in the spherical regular triangle T2 intersect the comparting great circle L1. Moreover, four other dimples intersect the comparting great circle L2. Furthermore, four other dimples intersect the comparting great circle L3.

The dimple pattern of the spherical regular triangle T2 is not line symmetrical with respect to the great circle L7 connecting the apex P1 to a center of gravity of the spherical regular triangle T2. Moreover, the same dimple pattern is not line symmetrical with respect to the great circle L8 connecting the apex P3 to a center of gravity of the spherical regular triangle T2. Furthermore, the same dimple pattern is not line symmetrical with respect to the great circle L5 connecting the apex P4 to a center of gravity of the spherical regular triangle T2. As is apparent from the foregoing, there is no line dividing the dimple pattern symmetrically in a transverse direction. In other words, the dimple patterns in the spherical regular triangle T2 are not line symmetrical.

Even if the dimple pattern of the spherical regular triangle T2 is rotated around a center of gravity (an intersecting point of the great circles L7, L8 and L5), all the dimples do not completely overlap with the dimples which have not been rotated before a rotating angle reaches 360 degrees. In other words, the dimple patterns in the spherical regular triangle T2 are not rotation symmetrical.

The dimple pattern of the spherical regular triangle T8 is also equivalent to that of the spherical regular triangle T2 shown in FIG. 4. The dimple pattern will be hereinafter indicated as (II).

Figure 5:
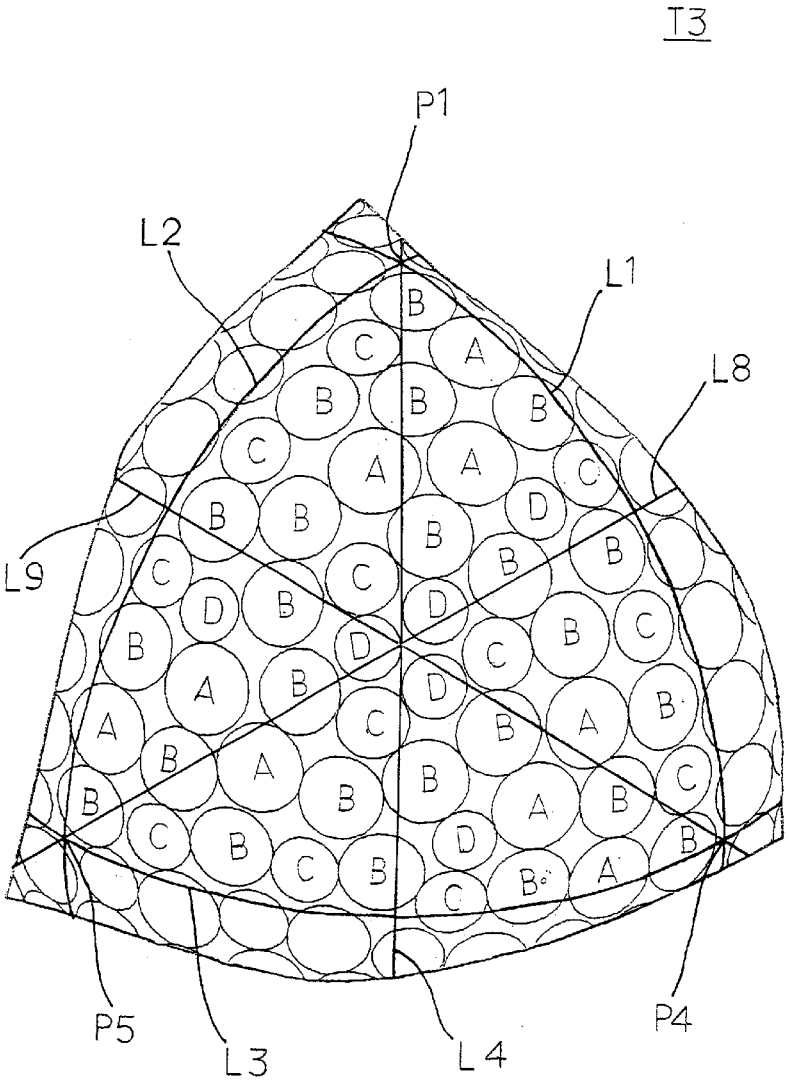
FIG. 5 is an enlarged view showing a spherical regular triangle T3 of the golf ball illustrated in FIG. 1.

FIG. 5 is an enlarged view showing the spherical regular triangle T3. The spherical regular triangle T3 includes nine A dimples having a diameter of 4.2 mm, twenty-four B dimples having a diameter of 3.95 mm, twelve C dimples having a diameter of 3.3 mm and six D dimples having a diameter of 2.95 mm. The total number of dimples is 51.

As is apparent from FIG. 5, four of the 51 dimples included in the spherical regular triangle T3 intersect the comparting great circle L1. Moreover, four other dimples intersect the comparting great circle L2. Furthermore, four other dimples intersect the comparting great circle L3.

The dimple pattern of the spherical regular triangle T3 is not line symmetrical with respect to the great circle L4 connecting the apex P1 to a center of gravity of the spherical regular triangle T3. Moreover, the same dimple pattern is not line symmetrical with respect to the great circle L9 connecting the apex P4 to a center of gravity of the spherical regular triangle T3. Furthermore, the same dimple pattern is not line symmetrical with respect to the great circle L8 connecting the apex P5 to a center of gravity of the spherical regular triangle T3. As is apparent from the foregoing, there is no line dividing the dimple pattern symmetrically in a transverse direction. In other words, the dimple patterns in the spherical regular triangle T3 are not line symmetrical.

Even if the dimple pattern of the spherical regular triangle T3 is rotated around a center of gravity (an intersecting point of the great circles L4, L9 and L8), all the dimples do not completely overlap with the dimples which have not been rotated before a rotating angle reaches 360 degrees. In other words, the dimple patterns in the spherical regular triangle T3 are not rotation symmetrical.

The dimple pattern of the spherical regular triangle T5 is also equivalent to that of the spherical regular triangle T3 shown in FIG. 5. The dimple pattern will be hereinafter indicated as (III).

Figure 6:
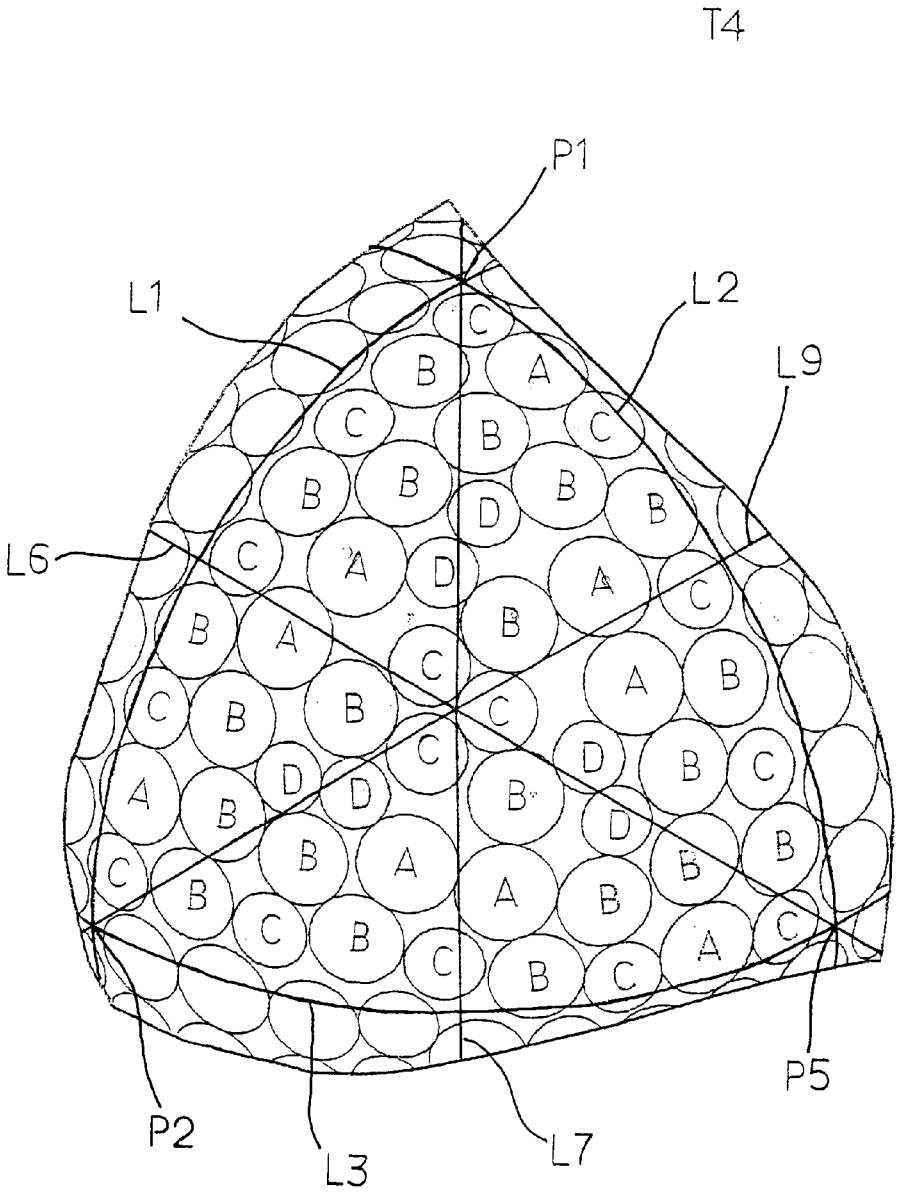
FIG. 6 is an enlarged view showing a spherical regular triangle T4 of the golf ball illustrated in FIG. 1.

FIG. 6 is an enlarged view showing the spherical regular triangle T4. The spherical regular triangle T4 includes nine Adimples having a diameter of 4.2 mm, twenty-one B dimples having a diameter of 3.95 mm, fifteen C dimples having a diameter of 3.3 mm and six D dimples having a diameter of 2.95 mm. The total number of dimples is 51.

As is apparent from FIG. 6, four of the 51 dimples included in the spherical regular triangle T4 intersect the comparting great circle L1. Moreover, four other dimples intersect the comparting great circle L2. Furthermore, four other dimples intersect the comparting great circle L3.

The dimple pattern of the spherical regular triangle T4 is not line symmetrical with respect to the great circle L7 connecting the apex P1 to a center of gravity of the spherical regular triangle T4. Moreover, the same dimple pattern is not line symmetrical with respect to the great circle L6 connecting the apex P5 to a center of gravity of the spherical regular triangle T4. Furthermore, the same dimplepattern is not line symmetrical with respect to the great circle L9 connecting the apex P2 to a center of gravity of the spherical regular triangle T4. As is apparent from the foregoing, there is no line dividing the dimple pattern symmetrically in a transverse direction. In other words, the dimple patterns in the spherical regular triangle T4 are not line symmetrical.

Even if the dimple pattern of the spherical regular triangle T4 is rotated around a center of gravity (an intersecting point of the great circles L7, L6 and L9), all the dimples do not completely overlap with the dimples which have not been rotated before a rotating angle reaches 360 degrees. In other words, the dimple patterns in the spherical regular triangle T4 are not rotation symmetrical.

The dimple pattern of the spherical regular triangle T6 is also equivalent to that of the spherical regular triangle T4 shown in FIG. 6 The dimple pattern will be hereinafter indicated as (IV).

The dimple patterns (I) to (IV) are different from each other (not identical to each other). More specifically, even if any of the dimple patterns (I) to (IV) is caused to overlap with another dimple pattern in any way, both dimples do not completely overlap with each other.

Figure 7:
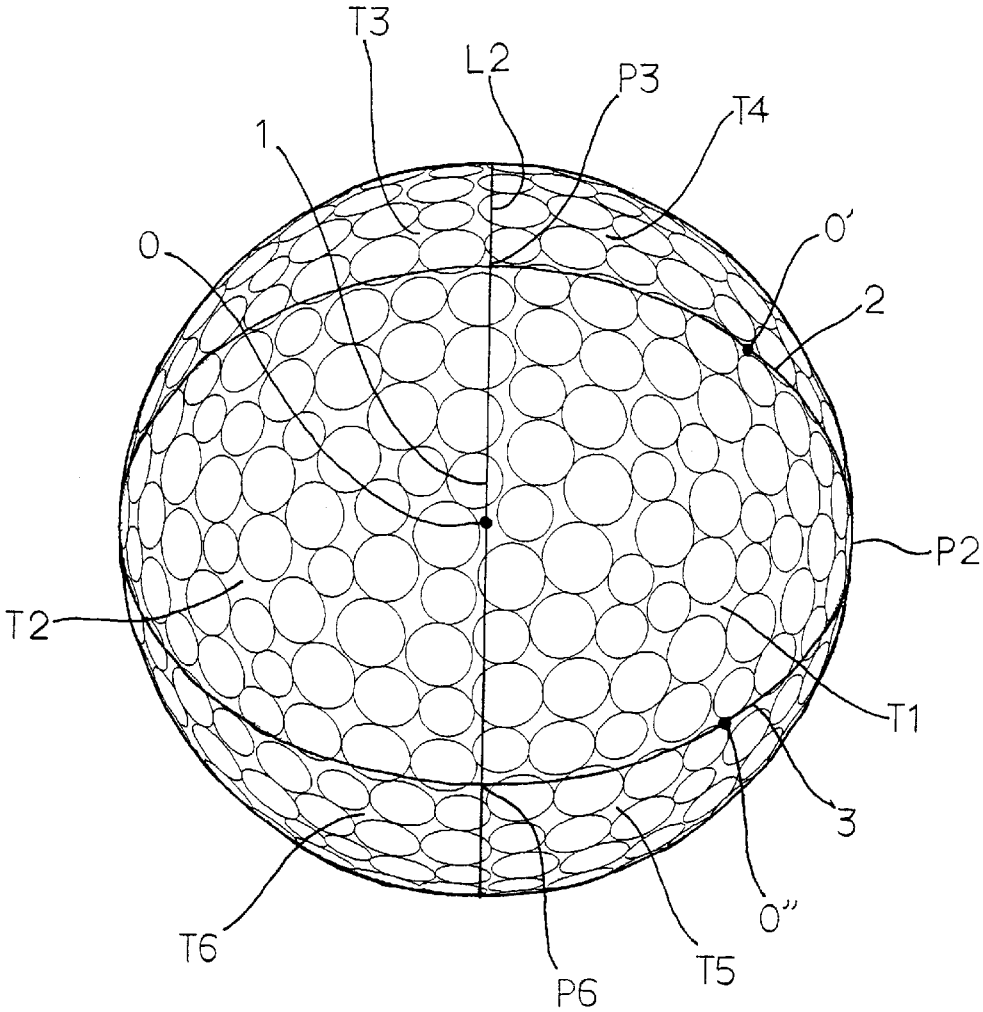
FIG. 7 is a perspective view showing the golf ball of FIG. 1.

FIG. 7 is a perspective view showing the golf ball of FIG. 1. FIG. 7 illustrates the spherical regular triangles T1, T2, T3, T4, T5 and T6. The spherical regular triangle T7 is positioned on just the back of the spherical regular triangle T2 and the spherical regular triangle T8 is positioned on just the back of the spherical regular triangle T1, which are not shown.

The four spherical regular triangles T1, T2, T3 and T4 sharing the apex P3 are present therearound. They have dimple patterns (I), (II), (III) and (IV) as described above. More specifically, the dimple patterns of the four spherical regular triangles T1, T2, T3 and T4 sharing the apex P3 are not identical to each other. The four spherical regular triangles T5, T6, T2 and T1 sharing the apex P6 are present therearound. They have dimple patterns (III), (IV), (I) and (II) as described above. More specifically, the dimple patterns of the four spherical regular triangles T5, T6, T2 and T1 sharing the apex P6 are not identical to each other. The dimple patterns of the four spherical regular triangles sharing each of the apexes P1, P2, P4 and P5 are not identical to each other, which is not shown in FIG. 7.

The spherical regular triangle T1 and the spherical regular triangle T2 share a comparting line 1. As described above, the spherical regular triangle T1 has the dimple pattern (I) and the spherical regular triangle T2 has the dimple pattern (II). Accordingly, the dimple pattern of the spherical regular triangle T1 and that of the spherical regular triangle T2 are not symmetrical with respect to the comparting line 1. Moreover, the dimple pattern of the spherical regular triangle T1 and that of the spherical regular triangle T2 are not symmetrical with respect to a middle point O of the comparting line 1. In this specification, the state in which the dimple patterns of the two spherical regular triangles sharing the comparting line are not symmetrical with respect to the comparting line and are not symmetrical with respect to the middle point of the comparting line is referred to as the expression of "both dimple patterns are not equivalent to each other".

The spherical regular triangle T1 and the spherical regular triangle T4 share a comparting line 2. As described above, the spherical regular triangle T1 has the dimple pattern (I) and the spherical regular triangle T4 has the dimple pattern (IV). Accordingly, the dimple pattern of the spherical regular triangle T1 and that of the spherical regular triangle T4 are not symmetrical with respect to the comparting line 2. Moreover, the dimple pattern of the spherical regular triangle T1 and that of the spherical regular triangle T4 are not symmetrical with respect to a middle point O' of the comparting line 2. In other words, the dimple pattern of the spherical regular triangle T1 is not equivalent to that of the spherical regular triangle T4.

The spherical regular triangle T1 and the spherical regular triangle T5 share a comparting line 3. As described above, the spherical regular triangle T1 has the dimple pattern (I) and the spherical regular triangle T5 has the dimple pattern (III). Accordingly, the dimplepatternof the spherical regular triangle T1 and that of the spherical regular triangle T5 are not symmetrical with respect to the comparting line 3. Moreover, the dimple pattern of the spherical regular triangle T1 and that of the spherical regular triangle T5 are not symmetrical with respect to a middle point O" of the comparting line 3. In other words, the dimple pattern of the spherical regular triangle T1 is not equivalent to that of the spherical regular triangle T5.

The spherical regular triangles T1 and T3 share the apex P3 and are opposed to each other. As described above, the spherical regular triangle T1 has the dimple pattern (I) and the spherical regular triangle T3 has the dimple pattern (III). Accordingly, the dimple pattern of the spherical regular triangle T1 and that of the spherical regular triangle T3 are not symmetrical with respect to the apex P3. Moreover, the dimple pattern of the spherical regular triangle T1 and that of the spherical regular triangle T3 are not symmetrical with respect to any line passing through the apex P3. In this specification, the dimple patterns of two spherical regular triangles sharing the apex and opposed to each other are not symmetrical with respect to the same apex and the state in which the dimple patterns are not symmetrical with respect to any line passing through the apex is also referred to as the expression of "both dimple patterns are not equivalent to each other".

The spherical regular triangles T1 and T6 share the apex P6 and are opposed to each other. As described above, the spherical regular triangle T1 has the dimple pattern (I) and the spherical regular triangle T6 has the dimple pattern (IV). Accordingly, the dimple pattern of the spherical regular triangle T1 and that of the spherical regular triangle T6 are not symmetrical with respect to the apex P6. Moreover, the dimple pattern of the spherical regular triangle T1 and that of the spherical regular triangle T6 are not symmetrical with respect to any line passing through the apex P6. In other words, the dimple pattern of the spherical regular triangle T1 is not equivalent to that of the spherical regular triangle T6.

In the case in which the comparting great circle L2 is coincident with the highest speed portion and the golf ball rotates upward in FIG. 7, the spherical regular triangle T4 appears in the front part on the right side of the comparting great circle L2 and the spherical regular triangle T3 appears in the front part on the left side of the comparting great circle L2 immediately before the spherical regular triangle T1 appears in the front part on the right side of the comparting great circle L2. Moreover, when the spherical regular triangle T1 appears in the front part on the right side of the comparting great circle L2, the spherical regular triangle T2 appears in the front part on the left side of the comparting great circle L2. Furthermore, immediately after the spherical regular triangle T1 appears in the front part on the right side of the comparting great circle L2, the spherical regular triangle T5 appears in the front part on the right side of the comparting great circle L2 and the spherical regular triangle T6 appears in the front part on the left side of the comparting great circle L2.

Thus, the spherical regular triangles T4, T3, T2, T5 and T6 appear in the front part immediately before and after the appearance of the spherical regular triangle T1 in the front part. The dimple patterns of these spherical regular triangles are neither identical nor equivalent to the dimple pattern of the spherical regular triangle Tl. In this specification, such a state is referred to as the expression of "a dimple pattern appearing through rotation is not monotonous".

While the above-mentioned consideration has mainly been made for the spherical regular triangle T1, any dimple pattern appearing through rotation is not monotonous in the golf ball according to the present invention also in the case in which any of the other spherical regular triangles (T2 to T8) is mainly taken into consideration. In the golf ball according to the present invention, moreover, any dimple pattern appearing through rotation is not monotonous also in the case in which the comparting great circles L1, L2 and L3 are coincident with the highest speed portion. In the case in which the comparting great circles L1, L2 and L3 are coincident with the highest speed portion, consequently, dimple effects can be enhanced.

In the golf ball, as described above, all the twelve comparting lines intersect four dimples included in the spherical regular triangles on one of sides and also intersect four dimples included in the spherical regular triangles on the other side. The intersection can prevent the generation of a region having a large area in which any dimple is not present on the comparting great circle. In the case in which the comparting great circles L1, L2 and L3 are coincident with the highest speed portion, consequently, the dimple effects can be more enhanced. While the number of intersections is not restricted to four, the number of two or more, particularly four or more is preferable.

As described above, the dimple patterns in the spherical regular triangles (T1 to T8), that is, the dimple patterns (I), (II), (III) and (IV) are neither rotation symmetrical nor line symmetrical by themselves. Consequently, the disturbance of air is promoted during the flight of the golf ball so that the flight performance of the golf ball can be enhanced.

While each of the spherical regular triangles (T1 to T8) of the golf ball has 51 dimples arranged therein, the number of the dimples to be arranged can be changed properly. It is preferable that the number of the dimples should be 40 to 55. In some cases in which the number of the dimples is less than 40, land portions other than the dimples are increased over the surface of the golf ball so that the dimple effects are reduced, resulting in poor flight performance of the golf ball. To the contrary, in some cases in which the number of the dimples is more than 55, the sizes of the individual dimples are decreased so that the dimple effects are reduced, resulting in poor flight performance of the golf ball.

The spherical regular triangles (T1 to T8) may have different numbers of dimples arranged therein. In respect of the maintenance of aerodynamic symmetry, a difference between the number of dimples in the spherical regular triangle having the greatest number of dimples arranged therein and the number of dimples in the spherical regular triangle having the smallest number of dimples arranged therein is preferably four or less, more preferably three or less, most preferably two or less, and ideally zero. Moreover, it is preferable that the number of dimples for each type should be unified between the spherical regular triangles (T1 to T8) if possible. Also in the case in which the number of dimples for each type is varied, it is preferable that a difference in a diameter between the numbers-different-dimples should be 0.75 mm or less.

Any dimple having a center thereof positioned on a comparting line is not present at all in the golf ball. In other words, the dimple intersecting the comparting line is unevenly present in the spherical regular triangles on both sides of the comparting line. In the case in which the comparting great circles L1, L2 and L3 are coincident with the highest speed portion, consequently, the dimple effects can be more enhanced.

One of the three comparting great circles L1, L2 and L3 may be almost coincident with a seam. The seam has a drawback in that the surrounding dimples might be deformed by grinding of a spew. However, the dimple pattern appearing through rotation is not monotonous, so it is possible to prevent the dimple effects from being reduced when the seam is almost coincident with the highest speed portion.

In respect of an enhancement in the aerodynamic characteristic of the golf ball, it is preferable that the dimple pattern appearing through rotation should not be monotonous when the comparting great circles L1, L2 and L3 are set in any positions of the spherical surface.

In the golf ball, as described above, both the spherical regular triangles T1 and T7 have the dimple pattern (I). The spherical regular triangles T1 and T7 are positioned symmetrically with respect to the center of the golf ball. More specifically, when the spherical regular triangle T1 is positioned on a front face, the spherical regular triangle T7 having the same dimple pattern is positioned on a back face. Similarly, when the spherical regular triangle T2 is positioned on the front face, the spherical regular triangle T8 having the same dimple pattern (II) is positioned on the back face. When the spherical regular triangle T3 is positioned on the front face, the spherical regular triangle T5 having the same dimple pattern (III) is positioned on the back face. When the spherical regular triangle T4 is positioned on the front face, the spherical regular triangle T6 having the same dimple pattern (IV) is positioned on the back face. Consequently, the excellent symmetrical property of the golf ball having a regular octahedron pattern can be maintained.

EXAMPLES

Example

An ionomer resin composition was subjected to injection molding to form a cover around a core made of solid rubber. Thus, a golf ball according to the example which has a regular octahedron dimple pattern shown in FIGS. 1 to 7 was obtained. A parting line of a mold during the injection molding was concavo-convex shaped and a position thereof was caused to be almost coincident with a comparting great circle L1. The golf ball had a diameter of 42.70 mm±0.03 mm and a compression of 90±2. Moreover, the sum of dimple volumes (a volume between a plane including a dimple edge and a dimple surface) was approximately 320 $mm^3$.

Comparative Example

Figure 8:
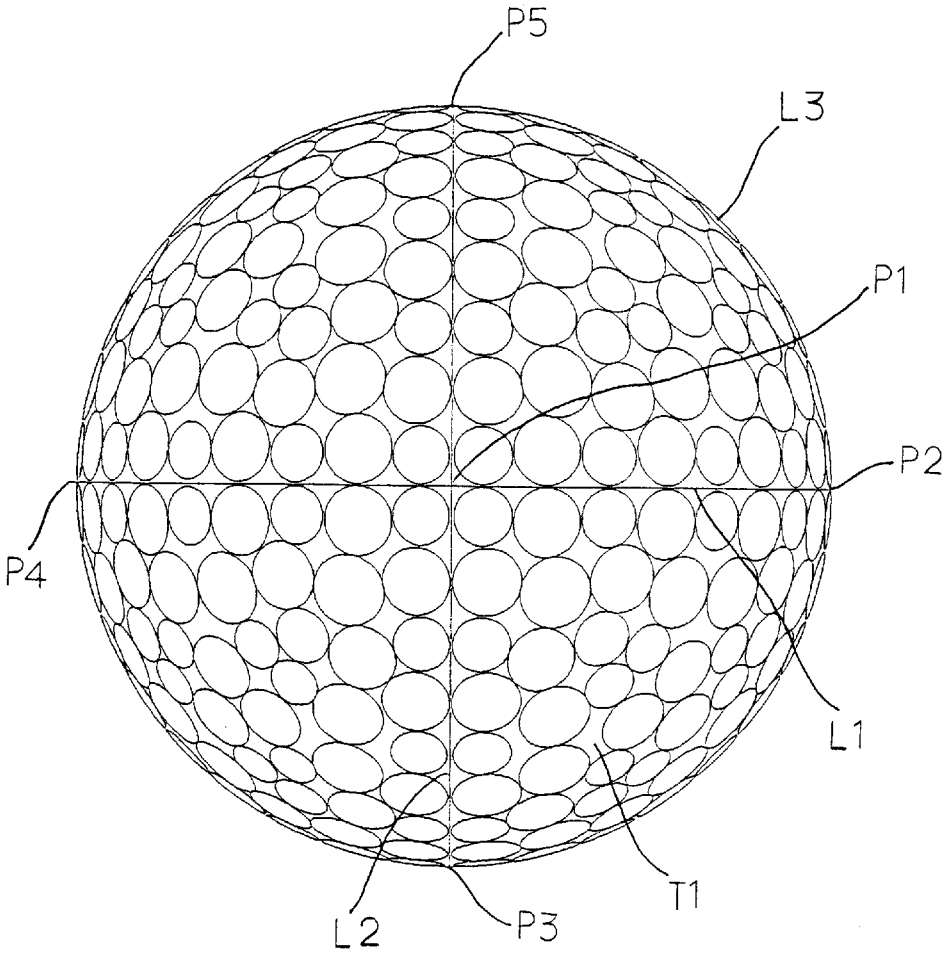
FIG. 8 is a front view showing a golf ball according to a comparative example.

For a comparative example, there was fabricated a golf ball having a regular octahedron pattern in which eight spherical regular triangles have the same dimple pattern and comparting great circles L1, L2 and L3 are great circle paths. FIG. 8 is a front view showing the golf ball. In the golf ball, the dimple pattern in each spherical regular triangle is rotation symmetrical and line symmetrical by itself. FIG. 8 is also a rear view showing the golf ball.

[Symmetry Test]

120 golf balls according to the example and 120 golf balls according to the comparative example were prepared. On the other hand, a driver (W1) having a metal head was attached to a swing robot manufactured by True Temper Co. and the conditions of a machine were adjusted to set a head speed of approximately 49 m/s, a launch angle of approximately 11 degrees and a backspin rotating angle of approximately 3000 rpm. Then, each golf ball was hit to measure a carry (a distance from a shooting point to a falling point) and a total flight distance (a distance from the shooting point to a stationary point). Setting is carried out in the following six ways: 1) a comparting great circle L1 is coincident with the highest speed portion, 2) a comparting great circle L2 is coincident with the highest speed portion, 3) a comparting great circle L3 is coincident with the highest speed portion, 4) a great circle L4 passing through an apex P1 and a center of gravity of a spherical regular triangle T1 is coincident with the highest speed portion, 5) a great circle L5 passing through an apex P2 and the center of gravity of the spherical regular triangle T1 is coincident with the highest speed portion, and 6) a great circle L6 passing through an apex P3 and the center of gravity of the spherical regular triangle T1 is coincident with the highest speed portion. 20 golf balls were hit for each setting. A mean value in the results of measurement is shown in the following Table 1. An almost head wind blew at a mean speed of approximately 1 m/s during the test.

TABLE 1

Result of Symmetry Test (m)

| Great circle coincident with highest speed portion | Example | Comparative Example |
|---|---|---|
| Carry | | |
| Comparting great circle L1 (seam) | 228.8 | 225.8 |
| Comparting great circle L2 | 229.2 | 226.2 |
| Comparting great circle L3 | 229.0 | 226.4 |
| Great circle L4 | 229.1 | 227.1 |
| Great circle L5 | 229.4 | 226.9 |
| Great Circle L6 | 229.3 | 226.8 |
| Mean | 229.1 | 226.5 |
| Total | | |
| Comparting great circle L1 (seam) | 267.4 | 262.8 |
| Comparting great circle L2 | 267.3 | 264.5 |
| Comparting great circle L3 | 267.2 | 263.9 |
| Great circle L4 | 267.4 | 264.7 |
| Great circle L5 | 267.4 | 263.8 |
| Great circle L6 | 267.8 | 264.2 |
| Mean | 267.4 | 264.0 |

In the Table 1, the golf ball according to the example has smaller differences in the carry and the total flight distance based on a variation in the hitting than the golf ball according to the comparative example. The mean carry and the mean total flight distance in the golf ball according to the example are greater than those of the golf ball according to the comparative example. From the results of evaluation, the advantages of the present invention have been apparent.

The above description is only illustrative and can be variously changed without departing from the scope of the present invention.

What is claimed is:

1. A golf ball in which twelve sides of a regular octahedron inscribed on a surface of the golf ball are projected onto the surface so that the surface is comparted into eight spherical regular triangles through twelve comparting lines virtually formed and three great circles are formed, and a plurality of dimples are arranged on the spherical regular triangles and all the three great circles intersect the dimples, wherein dimple patterns of four spherical regular triangles sharing each of six apexes of the regular octahedron positioned on the surface are not identical to each other, dimple patterns of two spherical regular triangles sharing each of the six apexes of the regular octahedron positioned on the surface and opposed to each other are neither line symmetrical nor point symmetrical with each other, and dimple patterns of two spherical regular triangles sharing each of any of the twelve comparting lines are neither line symmetrical nor point symmetrical with each other.

2. The golf ball according to claim 1, wherein all the twelve comparting lines intersect the dimples.

3. The golf ball according to claim 1, wherein each the eight spherical regular triangles has an internal dimple pattern which is neither rotation symmetrical nor line symmetrical.

4. The golf ball according to claim 1, wherein the number of dimples arranged in each of the eight spherical regular triangles is 40 to 55.

5. The golf ball according to claim 1, wherein a difference between the number of dimples in the spherical regular triangle having the greatest number of dimples arranged therein and the number of dimples in the spherical regular triangle having the smallest number of dimples arranged therein is four or less.

6. The golf ball according to claim 1, wherein there is no dimple having a center thereof positioned on the comparting line.

7. The golf ball according to claim 1, wherein one of three great circles formed by the twelve comparting lines is almost coincident with a seam to be a portion corresponding to a parting line of a pair of golf ball molds including semi-spherical cavities.

* * * * *